US006359564B1

(12) United States Patent
Thacker

(10) Patent No.: US 6,359,564 B1
(45) **Date of Patent: *Mar. 19, 2002**

(54) OCCUPANCY STATUS INDICATOR

(76) Inventor: Ralph W. Thacker, P.O. Box 1416, Ferndale, CA (US) 95536

( * ) Notice: Subject to any disclaimer, the term of this patent is extended or adjusted under 35 U.S.C. 154(b) by 0 days.

This patent is subject to a terminal disclaimer.

(21) Appl. No.: 09/652,551

(22) Filed: Aug. 31, 2000

Related U.S. Application Data

(63) Continuation-in-part of application No. 09/431,718, filed on Oct. 28, 1999, now Pat. No. 6,147,608.

(51) Int. Cl.[7] ..... G08B 23/00

(52) U.S. Cl. ..... 340/573.1; 340/573.4; 340/521; 340/522; 340/330; 340/331; 340/332

(58) Field of Search ..... 340/573.1, 573.4, 340/521, 522, 330, 331, 332

(56) References Cited

U.S. PATENT DOCUMENTS

| | | | | | |
|---|---|---|---|---|---|
| 3,964,058 | A | | 6/1976 | Winston | 340/330 |
| 4,340,879 | A | | 7/1982 | Laflamme | 340/286 R |
| 4,476,461 | A | | 10/1984 | Carubia | 340/667 |
| 4,679,034 | A | | 7/1987 | Kamada | 340/567 |
| 5,371,489 | A | | 12/1994 | Carroll et al. | 340/326 |
| 5,543,797 | A | | 8/1996 | Hockstein et al. | 342/42 |
| 5,640,141 | A | | 6/1997 | Myllymaki | |
| 5,703,367 | A | | 12/1997 | Hashimoto et al. | 250/342 |
| 5,703,368 | A | | 12/1997 | Tomooka et al. | |
| 5,717,867 | A | | 2/1998 | Wynn et al. | 364/401 R |
| 5,785,243 | A | * | 7/1998 | Cross | 236/47 |
| 5,861,806 | A | | 1/1999 | Vories et al. | 340/555 |
| 5,877,688 | A | | 3/1999 | Morinaka et al. | |
| 5,905,436 | A | | 5/1999 | Dwight et al. | |
| 5,971,597 | A | | 10/1999 | Baldwin et al. | |
| 5,973,594 | A | * | 10/1999 | Baldwin et al. | 340/506 |
| 6,160,479 | A | * | 2/2000 | Ahlen et al. | 340/555 |
| 6,078,253 | A | | 6/2000 | Fowler | |
| 6,137,407 | A | | 10/2000 | Akagawa et al. | |
| 6,188,318 | B1 | | 2/2001 | Katz et al. | |
| 6,211,783 | B1 | | 4/2001 | Wang | |
| 6,222,191 | B1 | | 4/2001 | Myron et al. | |
| 6,236,303 | B1 | | 5/2001 | Wagner et al. | |
| 6,246,321 | B1 | | 6/2001 | Rechsteiner et al. | |

* cited by examiner

*Primary Examiner*—Jeffery Hofsass
*Assistant Examiner*—Hung Nguyen
(74) *Attorney, Agent, or Firm*—McGarry Bair LLP

(57) ABSTRACT

A system is disclosed for indicating the status of a person relative to a workspace. A motion detector senses the entry and exit of the person through a entryway of the space and distinguishes the difference between the person's presence when moving and when stationary. An indicator automatically displays a constant green light to announce the person's presence, a flashing green light when the telephone is being used, a flashing amber light for short duration absences, a constant amber light for long duration absences and an intermittent red light and beeper for emergencies. A controller houses a preprogrammed microprocessor, a communications link and three illuminated buttons corresponding in color to the lights of the indicator and functioning in tandem with them. The green button activates the "Do not disturb" display, the amber button the long duration absence display and the red button the emergency alarm. In a second embodiment, a computer is connected to the controller for entering whereabouts messages and for receiving status indications and whereabouts messages from other workspaces. Occupancy status indications may be expressed by the indicator lights and beeper and/or as graphics on the computer monitor. In a third embodiment, the program is loaded into the computer. All manual commands are entered by combinations of "hot keys" on its keyboard and selected indicator settings may be changed from remote locations. In all three embodiments, a silent alert may be sent to selected, remote locations by use of a concealed switch.

19 Claims, 11 Drawing Sheets

OCCUPANCY STATUS INDICATOR

CROSS REFERENCE TO RELATED APPLICATION

This application is a continuation-in-part of U.S. application Ser. No. 09/431,718, filed Oct. 28, 1999 now U.S. Pat. No. 6,147,608.

BACKGROUND OF THE INVENTION

1. Field of the Invention

This invention relates generally to occupancy status monitoring and signaling systems.

2. Description of the Related Art

In many work environments, the occupancy of tall cubicles and enclosed offices cannot be ascertained from a distance. A person looking for the occupant of a cubicle or an office must walk to the cubicle or office to see if the occupant is there. Time is wasted and frustration is induced when the person being sought is not in the cubicle or office. Also, no means is usually available for announcing the wish not to be disturbed or for indicating, when leaving the workspace, whether the absence will be for a short or a long duration. Most importantly, no means is commonly available by which a person may request help when experiencing a medical emergency or when being threatened with physical harm.

Various devices for indicating occupancy in a room are known but they typically lack the ability to distinguish between random and directional motion and between a moving person and a stationary one. U.S. Pat. No. 5,861,806 to Vories et al. discloses an indicator that automatically indicates whether a room is occupied or not. However, it is designed for a limited-use space such as a restroom and cannot detect emergencies or register temporary absences or the desire to be undisturbed. U.S. Pat. No. 5,717,867 to Wynn et al. discloses a time entry and accounting system activated by individually encoded identification cards presented to computerized time clocks adjacent to employee workstations. The time clocks include screens for displaying messages from the central computer and buttons for sending information to the computer. However, the system does not monitor each workspace and automatically detect and indicate an employee's presence, absence or the occurrence of an emergency. U.S. Pat. No. 5,703,367 to Hashimoto et al. discloses a method for estimating the ratio of human occupancy in a restricted space. However, it is designed for monitoring the usage of high traffic areas, such as elevator lobbies and meeting rooms, and not for indicating the occupancy of workspaces. Consequently, it does not provide "Do not disturb," absence or emergency indications. U.S. Pat. No. 4,679,034 to Kamada discloses a device for detecting the presence of a human body in a sensing zone and generating audio and visual displays. However, it is intended as an intrusion alarm and does not monitor occupancy status under normal working conditions or provide for a multiplicity of displays. U.S. Pat. No. 4,476,461 to Carubia discloses an occupancy indicator that utilizes switches for monitoring occupancy in remote locations. Signals from the switches are transmitted to an occupancy information recorder through a communication circuit. However, the indicator does not include automatic detection of occupancy, absences, emergencies, or status displays at the locations being monitored. U.S. Pat. No. 4,340,879 to Laflamme shows a manually operated device featuring a plurality of indicators to register whether a person is in or out on a display in a reception area. However, no provision is made for automatic monitoring or for displaying occupancy status at each workstation. U.S. Pat. No. 3,964,058 to Winston shows a lighted "Do not disturb" sign which, is manually operated. It is designed for domestic use and does not provide automatic detection of occupancy, absences or emergencies.

SUMMARY OF THE INVENTION

An occupancy status indicator, according to the invention, comprises a motion detector, an indicator, and a controller, to which both the motion detector and the indicator are connected. The motion detector is adapted to send a signal when it detects motion in a space and when it detects the presence of a person in the space. The indicator displays information about the occupancy of the space, and the controller receives signals from the motion detector and activates the indicator. The controller will activate the indicator to display a first condition when the motion detector signals motion in the space and the presence of a person in the space, said motion and presence being a first status of occupancy. The controller will activate the indicator to display a second condition when no motion is detected in the space and the motion detector signals the presence of a person in the space, said presence and lack of motion being a second status of occupancy. The controller will activate the indicator to display a third condition when no motion is detected in the space and no person is detected in the space, said lack of motion and lack of presence being a third status of occupancy.

Preferably, the motion detector is a passive infrared sensor. The controller may be a dedicated component or a computer. Preferably, the indicator is a visual display, comprising three lights. Typically, the three lights will be red, amber, and green, where the green light indicates the first status of occupancy, the red light indicates the second status of occupancy, and the amber light indicates the third status of occupancy.

In one aspect of the invention, the visual display of occupancy status appears on a computer screen. In yet another aspect in the invention, the controller is connected to a communications network, allowing the indications of status to be sent to selected remote locations that are connected to said communications network. Additionally, a silent alert may be sent to selected remote locations by use of a concealed switch also connected to said controller.

In one aspect of the invention, the indicator is mounted on a cubicle defming the space. It may be that the space is partially enclosed and accessible by an entryway where the motion detector is positioned to detect the direction of motion through the entryway. In another aspect of the invention, either the controller or the motion detector can determine when no motion exists. This is typically done by sensing a predetermined period of a lapsed time from the last motion signal.

The indicator can be either a visual display or an audio display, or some combination of both. If audio, the preferable display is a beeper. The invention also contemplates the controller having a component, manually operable, to activate the indicator and to replicate its display.

Additionally, the system may control the working lights and office machines in the cubicle or office as an energy saving strategy.

DESCRIPTION OF THE PREFERRED EMBODIMENTS

Figure 1:
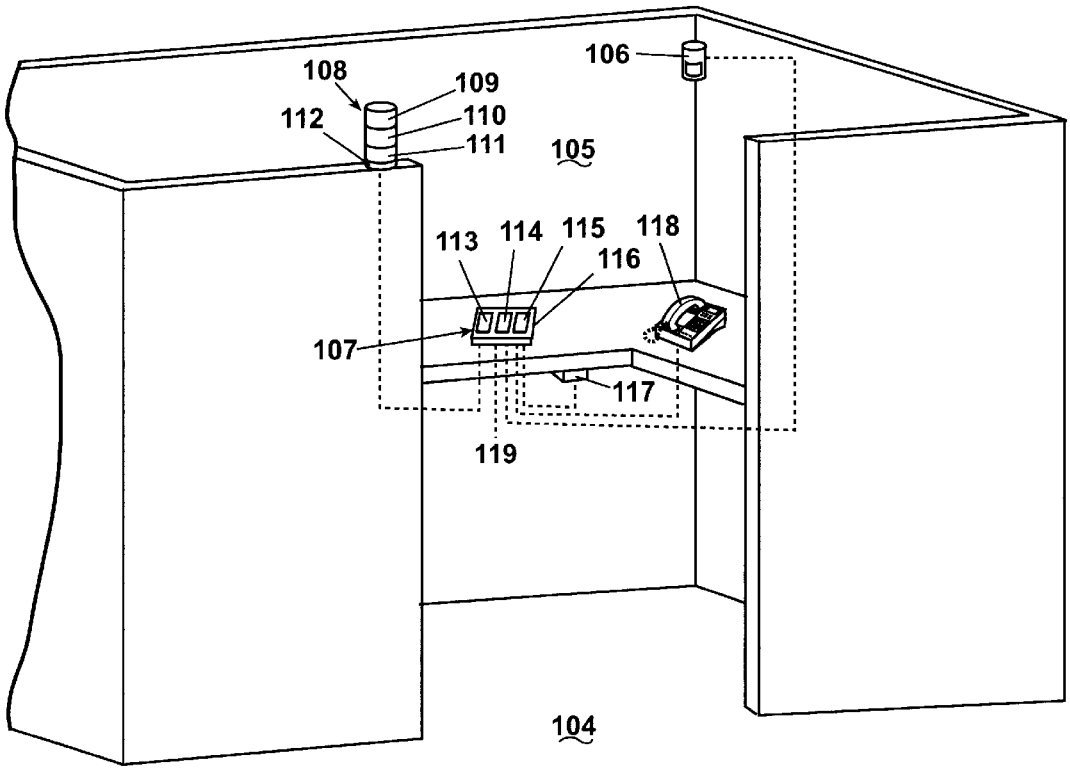
FIG. 1 is a front perspective view of a first embodiment of the present occupancy status indicator installed in a representative cubicle.

A first embodiment of the present occupancy status indicator is shown installed in a cubicle or monitored space 105 with an entryway 104 in FIG. 1. A motion detector 106, directed into the space 105, and an indicator 108, positioned in an easily visible location such as on top of the wall of the space 105, are connected to a controller 107. The indicator 108 is preferably a visual display that includes a first light 109, which is preferably red, a second light 110, which is preferably amber, a third light 111, which is preferably green, and an audio device or beeper 112. Lights 109–111 are visible 360 degrees around the indicator 108. It will be understood that the indicator 108 can be any sort of display that operates in a number of conditions and modes to convey information about three basic occupancy statuses in the referenced space, i.e., (1) occupied, (2) occupied with emergency, or (3) unoccupied. For example, the indicator 108 can be an LED or LCD panel on the cubicle or a screen display on a computer. The indicator 108 need not be located on or adjacent to the space; it can be positioned remotely such as on a wall in a large room or at a receptionist's desk or anywhere on a communications network. An audio component of the indicator 108 can supplement one or more video displays or it can supplant the video displays entirely for those who are visually impaired.

The controller 107 is primarily a microprocessing unit, which is loaded with a control program, as described more fully below, and includes a power switch 116. The controller 107 may be also connected to a concealed switch 117, located in an out-of-the-way place such as under the desk, for sending a silent alert to one or more remote locations, a sensor 118 for detecting when the receiver of a telephone in the monitored space is off of its cradle and activating a "Do not disturb" variation of the occupied status, and a communications link 119 for connecting to a communications network.

The controller 107 in the first embodiment includes three illuminated buttons 113–115, which correspond in color to the lights 109–111 of the indicator 108 and operate in tandem with them. The illuminated buttons may each have a light and a switch that are combined into a single unit, or may feature a light and a switch as separate components. Pressing one of the illuminated buttons 113–115 on the controller 107 activates the display of a corresponding light 109, 110 or 111 on the indicator 108. The lights 109–111 and the illuminated buttons 113–115 can be displayed in either the constant or a flashing mode. For example, when the red light 109 is displayed in a flashing mode, the red illuminated button 113 is also displayed in a flashing mode, and when the green light 11 is displayed in the constant mode, the green illuminated button 115 is also displayed in the constant mode. The synchronization of the illuminated buttons 113–115 with the lights 109–111 enables the occupant of a workspace to monitor the operation of the indicator 108 without having to look at it. Some exemplar statuses and their corresponding conditions and modes are as follows:

1. Occupied and approachable: green light and constant mode.
2. Occupied but do not disturb: green light and flashing mode.
3. Occupied with an emergency: red light and flashing mode and intermittent beeper.
4. Unoccupied for a short duration: amber light and flashing mode.
5. Unoccupied for a long duration: amber light and constant mode.

The motion detector 106 is critical to identifying the conditions displayed by the indicator 108. Its detection of motion in the space 105 suggests that the space is occupied. Its detection of no motion in the space 105 suggests that the space is either unoccupied or occupied with an emergency. The motion detector 106 is preferably a type that can detect both the presence of motion and the direction of motion, such as a passive infrared sensor. Thus, the motion detector 106 can communicate a signal to the controller 107 when motion is detected in the space 105. When positioned appropriately, the motion detector 106 can also communicate a separate signal to the controller 107 when passage is detected through the entryway 104 of the space 105. Yet further, it is possible for the motion detector 106 to discern the presence or absence of a person independent of detecting motion in the space 105 or passage through the entryway 104. For example, a passive infrared sensor can distinguish between the presence of a diffuse heat pattern (as when the space 105 is unoccupied) and the presence of a concentrated heat pattern (as from a person occupying the space 105). Thus, regardless of detecting any motion or exit, the motion detector 106 can still signal the occurrence of no motion if an immobile person is present in the space 105 so that the controller 107 can display an emergency alarm.

It will be understood that the occurrence of no motion situation can be established in a variety of ways within the scope of the invention. For example, the motion detector 106 can have an internal clock that will measure elapsed time after the last motion detected. Upon the expiration of a predetermined time period, the motion detector 106 can signal the occurrence of no motion to the controller 107. Similarly, the controller 107 can have an internal clock that measures the elapsed time since a motion signal was received from the motion detector 106. After the expiration of the predetermined period, the controller 107 will establish the occurrence of no motion.

When motion detector 106 detects the entry of a person through the entryway 104, and subsequent motion in the space 105, the green light 111 in the indicator 108 and the green illuminated button 115 on the controller 107 are automatically displayed in a constant mode to announce the person's presence. If the motion detector 106 subsequently detects no motion in the space 105 but does not detect an exit through the entryway 104, the green light 111 and the green illuminated button 115 are turned off and the red light 109 and the red illuminated button 113 are displayed in a flashing mode and the beeper 112 is sounded intermittently to indicate an emergency. If the motion detector 106 no longer detects motion in the space 105, and detects an exit through the entryway 104, but detects that an immobile person is still present in the space 105, the emergency alarm is also initiated. If the motion detector 106 detects no motion in the space 105, and detects an exit through the entryway, and detects that an immobile person is not present in the space, the green light 111 and the green illuminated button 115 are turned off and the amber light 110 and the amber illuminated button 114 are displayed in a flashing mode to indicate a short duration absence. If a predetermined length of time allocated to short duration absences elapses without the motion detector 106 having detected entry through the entryway, the amber light 110 and the amber illuminated button 114 are switched from a flashing to the constant mode to indicate a long duration absence. The emergency alarm, absence, and "Do not disturb" conditions and a command to reset the internal clock may be manually activated by pushing the appropriate button or combination of buttons on the controller 107. A silent alarm may be sent to one or more remote locations by use of a concealed switch 117 should the occupant of a cubicle or office be threatened with physical harm. A sensor 118 detects the lifting of a receiver on the telephone in the space from its cradle and the green light 111 and the green illuminated button 115 are displayed in a flashing mode as a "Do not disturb" condition. A communications link 119 may be incorporated to send occupancy status indications to remote locations via a communications network.

One or more functional modules may be joined to the microprocessing unit of the controller 107 to expand its ability to send, receive, and record signals and/or information. These functional modules include, but are not limited to, a parallel interface to permit attachment of a printer, an audible alert module to give an audible indication whenever status is accessed remotely, a voice module to record voice messages, an LCD display to record and display written messages, and a telephone module to allow status to be accessed and settings to be changed from a telephone.

Figure 2:
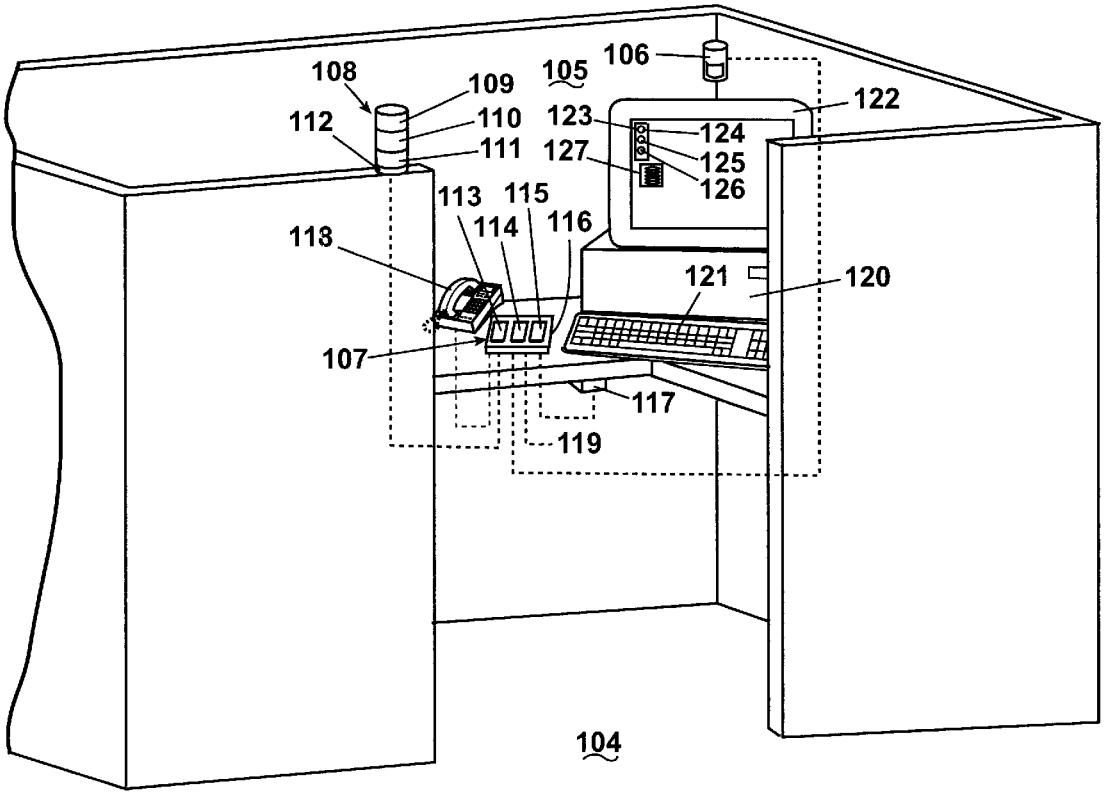
FIG. 2 is a front perspective view of a second embodiment thereof.

A second embodiment of the present occupancy status indicator is shown installed in a cubicle or monitored space 105 in FIG. 2. A motion detector 106, an indicator 108, which houses red, amber and green lights 109–111 and a beeper 112, are connected to a controller 107, which includes red, amber and green illuminated buttons 113–115, a power switch 116, and connections to a concealed switch 117, a telephone receiver sensor 118, and a communications link 119 as in the first embodiment in FIG. 1. In addition, a personal computer 120 is connected to the controller 107 by an interface that may include, but is not limited, to a serial interface, a parallel interface, a USB interface, a "FIRE WIRE" interface, an infrared interface, and a wireless radio frequency interface. The computer 120 includes a keyboard 121 and a monitor 122. As in the first embodiment, the occupancy status indicator is activated automatically or manually by pressing one or more of the buttons associated with the controller 107. Combinations of "hot keys" on the keyboard 121 of the computer 120 may be used to enter whereabouts messages and to receive status indications and whereabouts messages from other workstations.

The following combinations of "hot keys" represent one possible arrangement:

1. Simultaneously pressing the left-hand "Ctrl" and "Alt" keys on the keyboard 121 of the computer 120 causes an icon 123 to appear briefly in the upper left-hand corner of the monitor 122, displaying red, amber and/or green graphics 124–126, which replicate the display of the three lights 109–111 in the indicator 108.
2. Simultaneously pressing the right-hand "Alt" and "Ctrl" keys on the keyboard 121 displays a menu 127 on the monitor 122 with options for checking the occupancy status of other workspaces, posting notices of one's whereabouts during a long duration absence, and establishing or changing a password. Invoking the "Status-Checking" option produces a submenu with options for creating and checking lists of persons in designated work groups for whom occupancy status might be desired. Selecting the "Notice-Posting," or the "Password" option produces a dialog box asking for the user's password. Once the password is entered and verified, another dialog box appears with options for entering a brief message or for changing the person's password.

If voice recognition capability is available on the computer 120, the options for checking the status of other workspaces, posting notices of one's whereabouts during a long duration absence, and establishing or changing a password may be accessed with voice commands. These commands are preferably "Check" for checking on the status of displays by the indicator 108, "Status" for initiating checks on the status of other persons, "Notice" for posting notices of one's whereabouts during protracted absences, and "Password" for establishing or changing a password.

Figure 3:
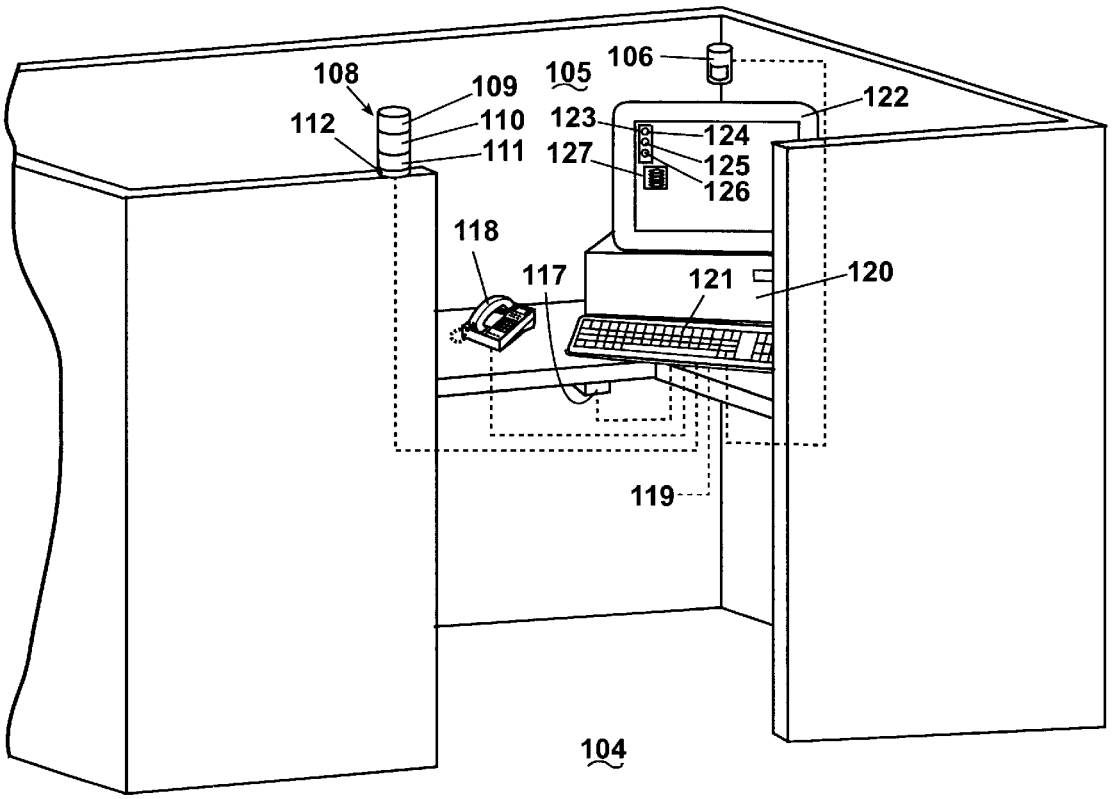
FIG. 3 is a front perspective view of a third embodiment thereof.

A third embodiment of the present occupancy status indicator is shown installed in a cubicle or monitored space 105 in FIG. 3. The motion detector 106, indicator 108, concealed switch 117, telephone receiver sensor 118, and communications link 119 are all connected directly to the computer 120, which includes a keyboard 121 and a monitor 122. The control program is loaded into the computer 120. Occupancy status displays may be implemented as graphics on the monitor 122 and the computer's internal buzzer and/or displayed via displays of the lights 109–111 and the beeper 112 in the indicator 108. Occupancy status displays are activated automatically as in the first two embodiments. Manual activation or alteration of occupancy status displays is accomplished by pressing combination of "hot keys" on the keyboard 121.

The following combinations of hot keys represent one possible arrangement:

1. Simultaneously pressing the "Alt" and "J" keys initiates and terminates the emergency alarm.
2. Simultaneously pressing the "Alt" and "K" keys initiates and terminates the long duration absence display.
3. Simultaneously pressing the "Alt" and "L" keys initiates and terminates the "Do not disturb" display.
4. Simultaneously pressing the "Alt," "K" and "L" activates the "Clock Reset" command.

As in FIG. 2, combinations of "hot keys" on the keyboard 121 of the computer 120 may be used to enter whereabouts messages, to receive status indications and messages from other workspaces, and to establish passwords. In addition, selected settings of the indicator 108 may be changed from the immediate workspace and also from remote locations. If the computer 120 has voice recognition capability, occupancy status may be accessed, messages may be entered and accessed, and password established and changed with verbal commands as in FIG. 2. In addition, occupancy status indications may be activated with verbal commands. The respective commands might be "Help" for emergencies, "Gone" for long duration absences, and "Busy" for wanting to work undisturbed.

FIGS. 4A–4I present a flowchart of the control program, which is loaded into the controller of FIGS. 1 and 2 or the computer of FIG. 3. Upon powering up, the space is continuously monitored for entry, motion and the presence of an inert body at steps 1–3 of routine A in FIG. 4A. If entry is detected at step 1 and no motion is detected at step 2 and the presence of an inert body is not detected at step 3, the program returns to step 1.

Figure 4A:
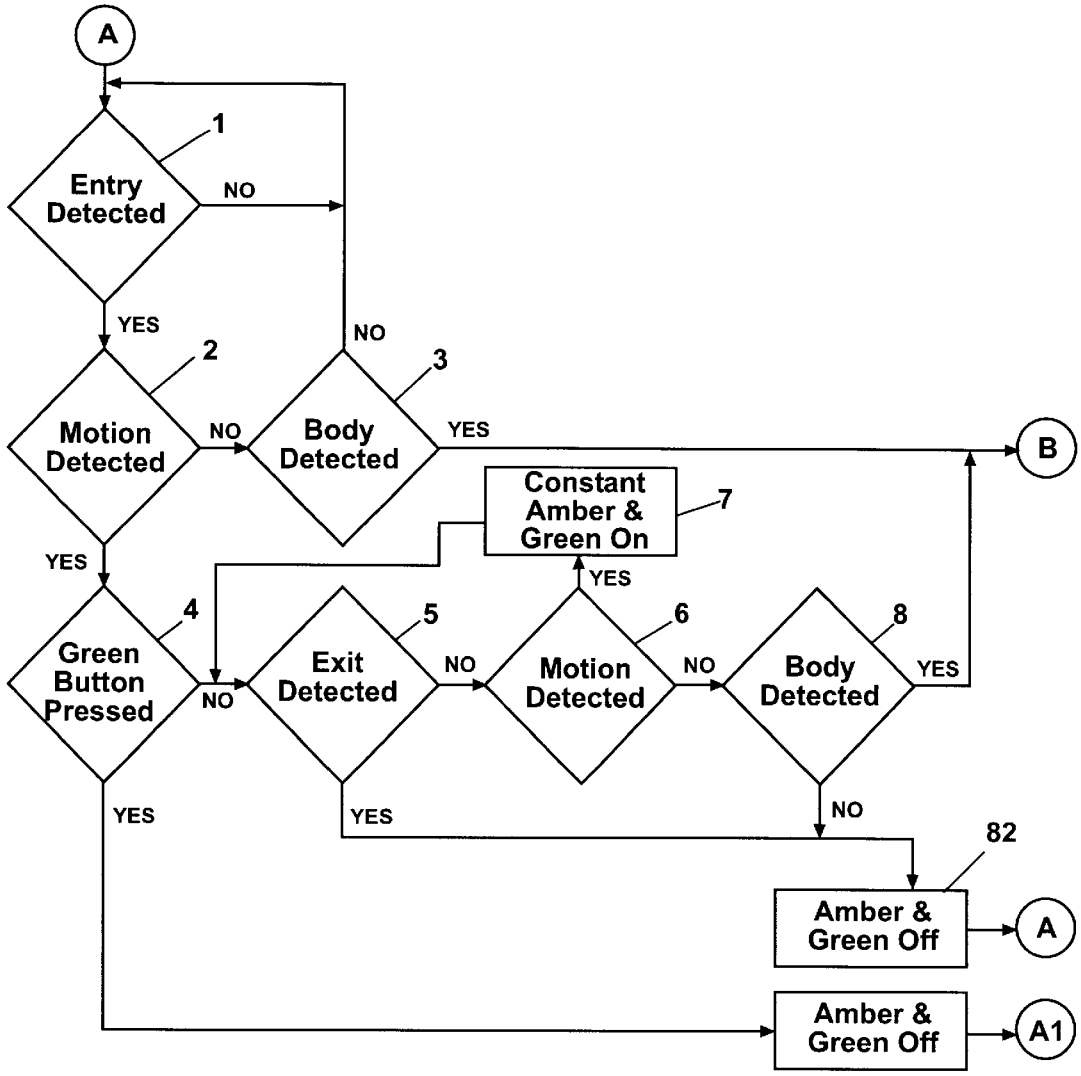
FIGS. 4A–4I present a partial flowchart of the control software thereof.
Figure 4B:
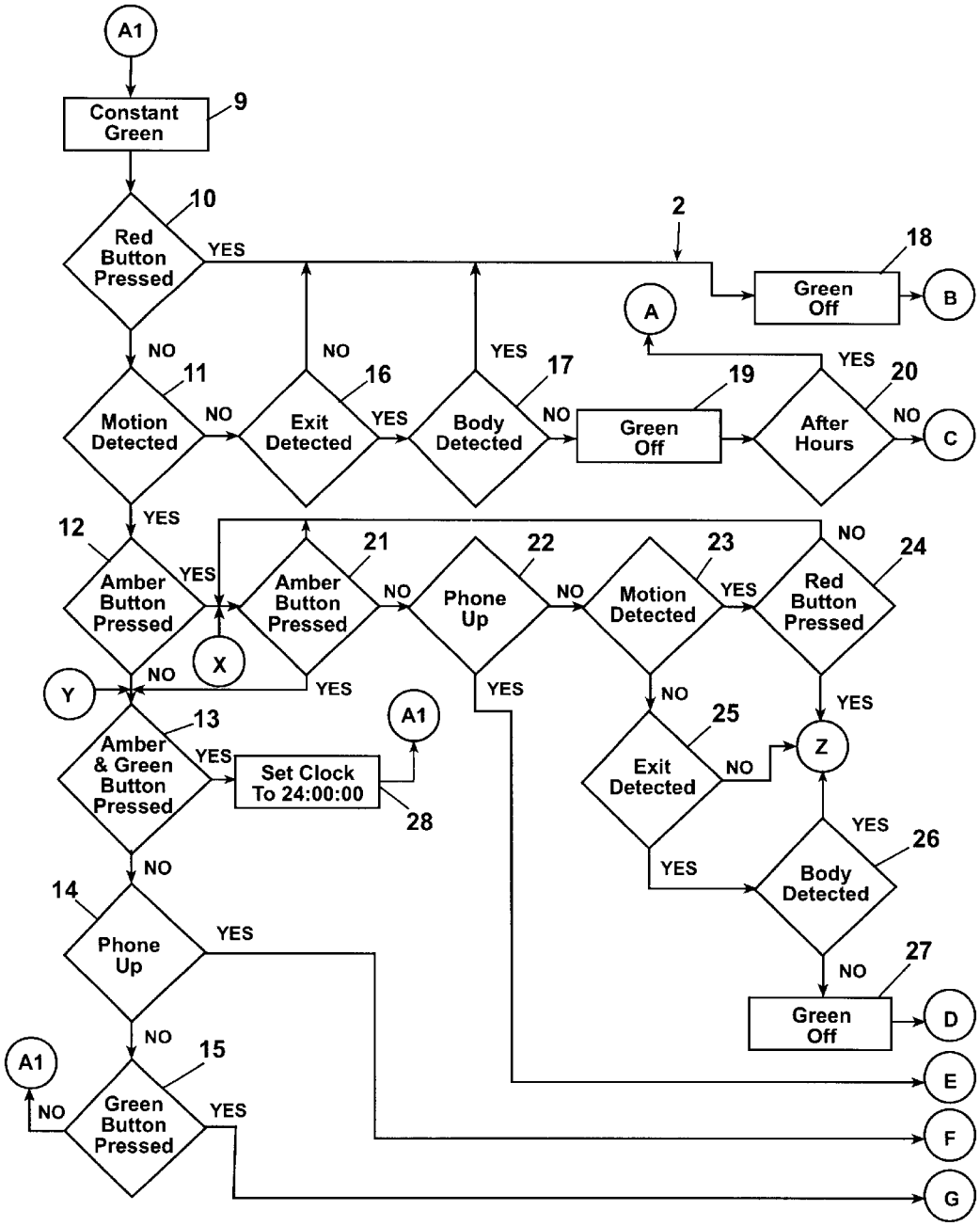
Figure 4C:
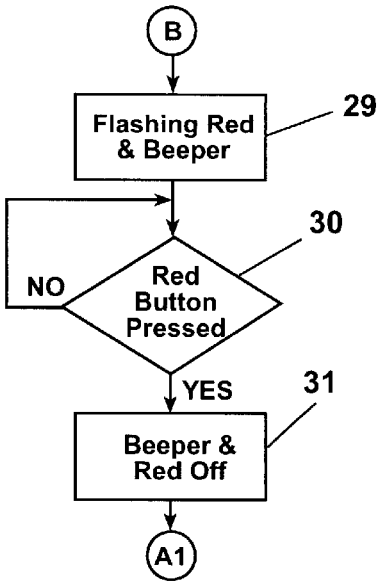

If entry is detected at step 1 and no motion is detected at step 2 but the presence of an inert body is detected at step 3, the program branches to the emergency alarm routine B shown in FIG. 4C. When entry is detected at step 1 and the green button (or its computer equivalent) is not pressed at step 4, and no exit is detected at step 5 and motion is detected at step 6, the constant amber and constant green lights are displayed at step 7 to indicate that a person other than the assigned occupant is in the workspace and the program returns to step 5. If the exit of the visitor from the space is detected at step 5, the amber and green lights are turned off at step 8*a* and the program returns to step 1. If the exit of the visitor from the space is not detected at step 5, and no motion is detected in the space at step 6 but the presence of an inert body is detected in the space at step 8, the emergency alarm routine is initiated. If the presence of an inert body is not detected at step 8, the amber and green lights are turned off at step 8*a* the program returns to step I.

If entry is detected at step 1 and motion is detected at step 2 and the green button (or its computer equivalent) is pressed at step 4 to announce the presence of the occupant assigned to the space, the amber and green lights are turned off at step 8*b* and the program branches to step 9 of routine A1 in FIG. 4B. If the assigned occupant arrives while a visitor is present, the constant amber and green lights are turned off at step 4*a* and before branching to step 9. The green lights in both the indicator and the controller or the computer monitor are then automatically displayed in the constant mode to indicate that the space is occupied by the assigned occupant.

While the green lights are displayed in the constant mode at step 9, the red button on the controller (or its computer equivalent) may be pressed at step 10 to indicate the occurrence of an emergency. The green lights are then turned off at step 18 and the program branches to the emergency alarm routine B shown in FIG. 4C. If the red button is not pressed at step 10, and the absence of motion is detected at step 11 but the exit of the occupant through the entryway is not detected at step 16, the constant green lights are turned off at step 18, and the emergency alarm routine is initiated. If the apparent exit of the occupant through the entryway is detected at step 16 but the presence of an inert body in the space is detected at step 17, the constant green lights are turned off at step 18, and the emergency alarm routine is initiated. If the presence of an inert body is not detected at step 17, the program concludes that the exit at step 16 is bona fide and turns off the constant green lights at step 19. If the occupant has exited during working hours plus a predetermined time period at step 20, the program branches to the short duration absence routine C shown in FIG. 4D. If the occupant has exited after working hours plus a predetermined time period at step 20, the program returns to step 1 of routine A in FIG. 4A.

When the emergency alarm routine B in FIG. 4C is initiated, the red lights are displayed in the flashing mode and the beeper is sounded intermittently at step 29. This audio-visual alarm continues until the red button (or its computer equivalent) is pressed again at step 30. The flashing red lights and the intermittent beeper are then turned off at step 31, and the program returns to step 9 of routine A1 in FIG. 4B. The emergency alarm may be sent to one or more selected locations on a communications network if one is connected.

Figure 4D:
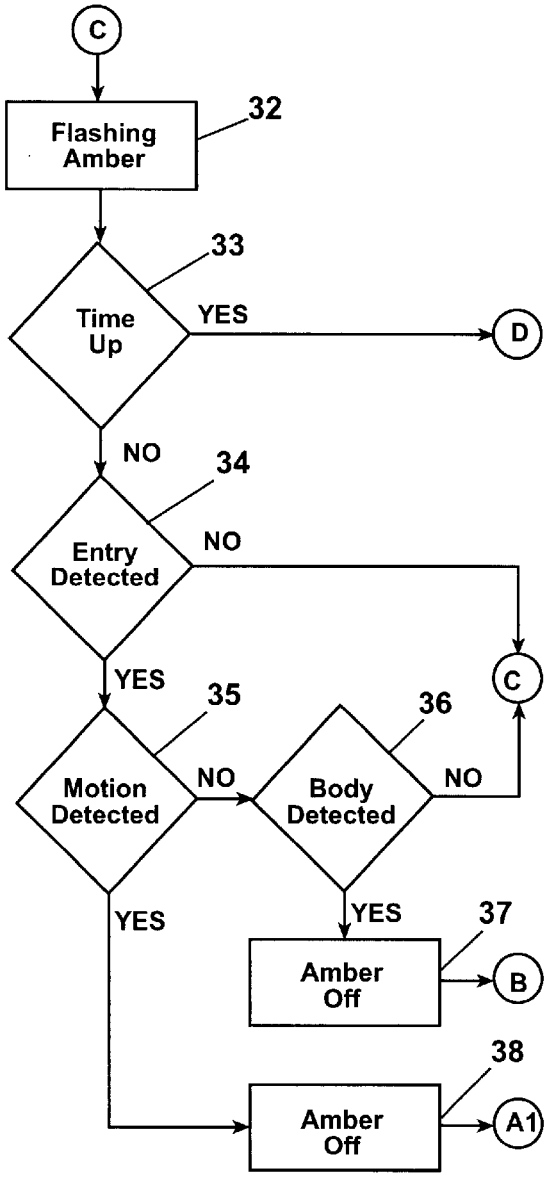

When the short duration absence routine C in FIG. 4D is initiated, the amber lights are displayed in a flashing mode at step 32 and the program begins a countdown period at step 33. If entry is detected during the countdown period at step 34, and motion is detected at step 35, the flashing amber lights are turned off at step 38 and the program returns to step 9 of routine A1 in FIG. 4B. If no entry is detected during the countdown period at step 34, the program returns to step 32. If entry is detected at step 34 and no motion is detected at step 35 but the presence of an inert body in the space is detected at step 36, the flashing amber lights are turned off at step 37 and the program branches to the emergency alarm routine B shown in FIG. 4C. If the presence of an inert body is not detected at step 36, the program returns to step 32. When the countdown period has elapsed at step 32, the program branches to the long duration absence routine D shown in FIGS. 4E and 4F.

When the green lights are being displayed in the constant mode at step 9 of routine A1 in FIG. 4B, and no intentional or automatic branching to the emergency alarm routine occurs at steps 10, 11, 16 or 17 and no automatic branching to the short duration absence routine occurs at step 20, the amber button (or its computer equivalent) may be pressed at step 12 to initiate branching to the long duration absence routine. The amber button may be pressed a second time within a predetermined number of seconds at step 21 to cancel branching to the long duration absence routine and continue on to step 13. If the amber button is not pressed a second time at step 21, and the receiver of the telephone in the space is not lifted from its cradle at step 22, and motion is detected at step 23, and the red button (or its computer equivalent) is not pressed at step 24, the program recycles through steps 21–24. If the receiver of the telephone is lifted from its cradle at step 22, the program branches to the "Do not disturb" routine E shown in FIG. 4G.

Figure 4E:
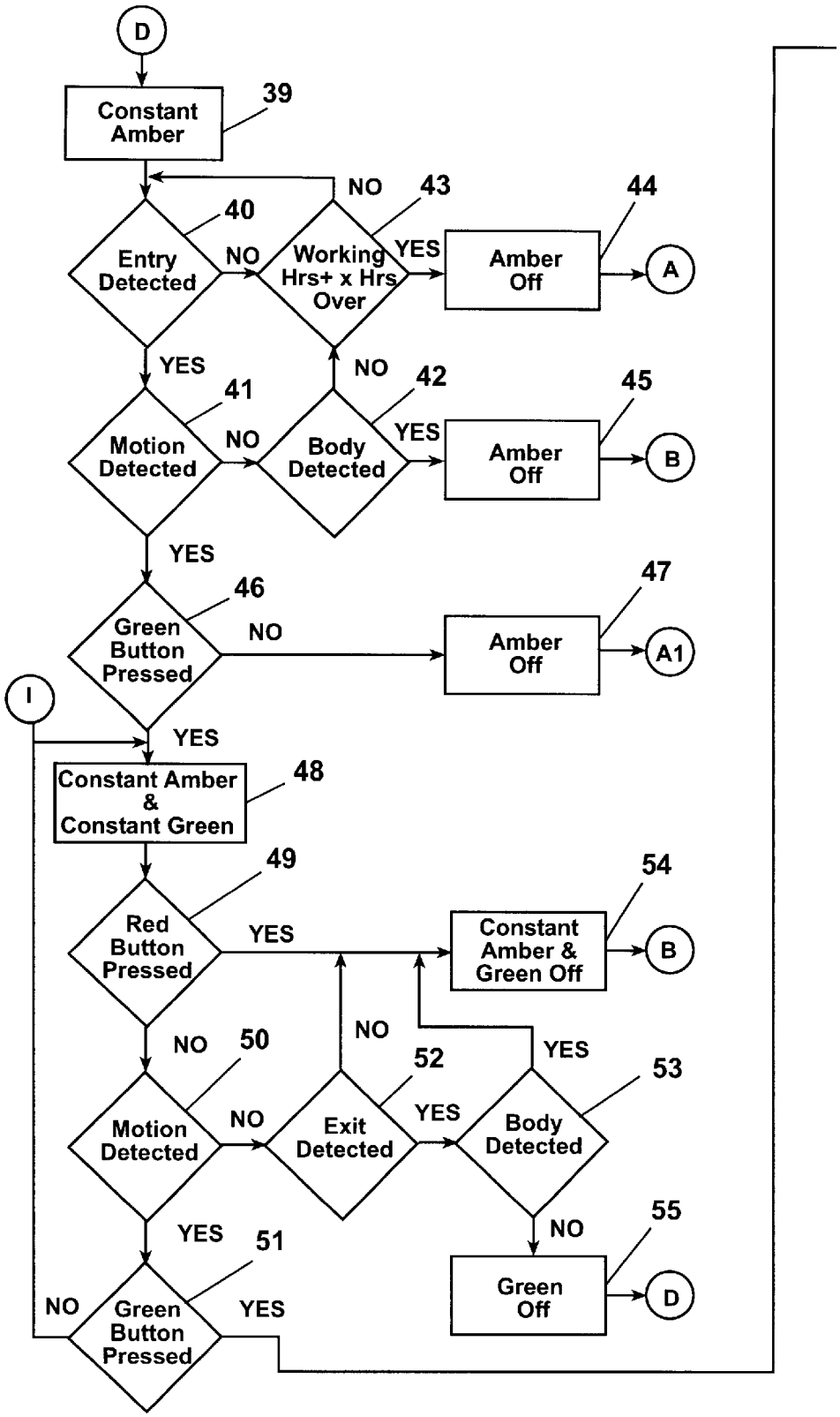
Figure 4F:
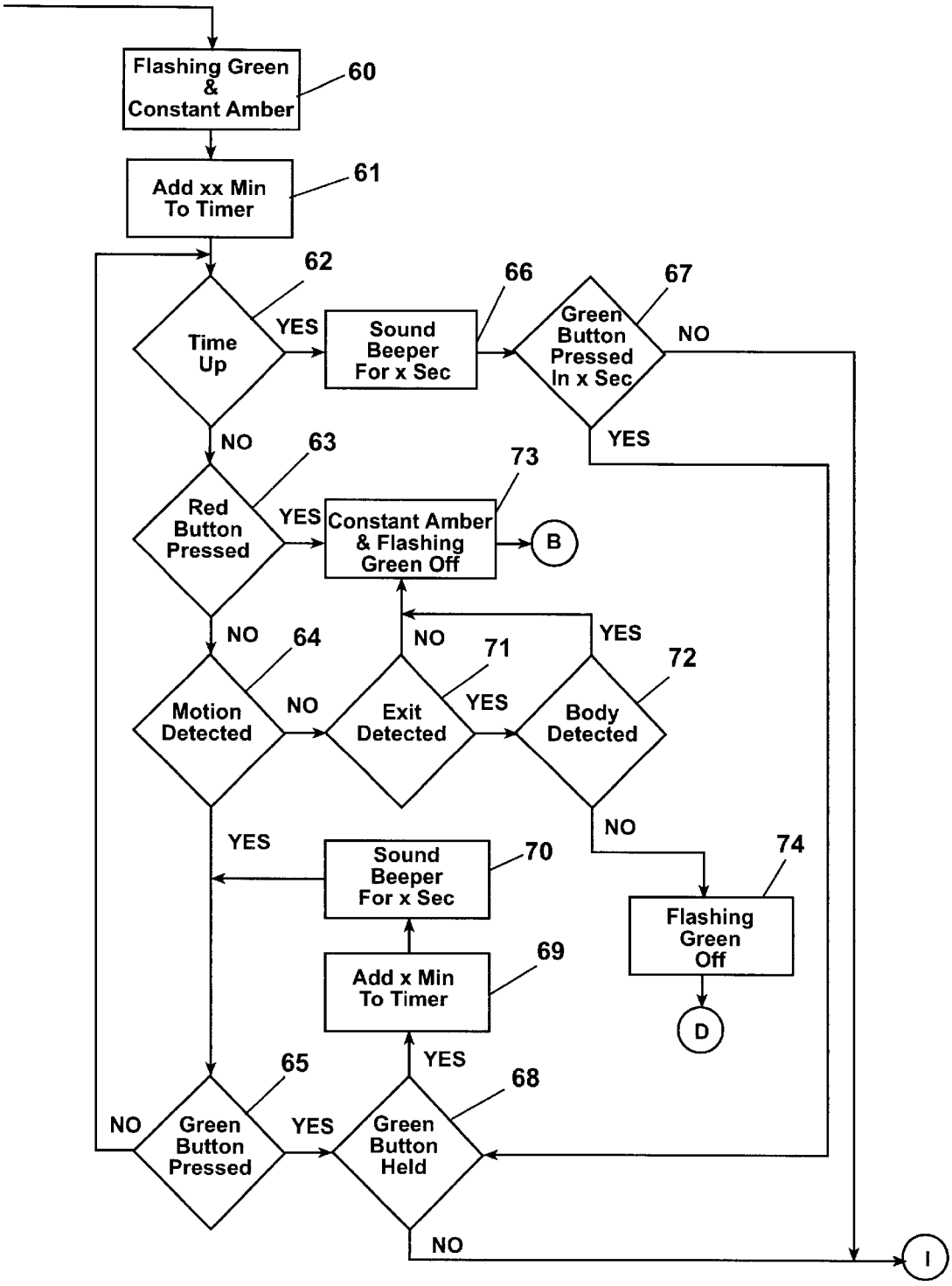
Figure 4G:
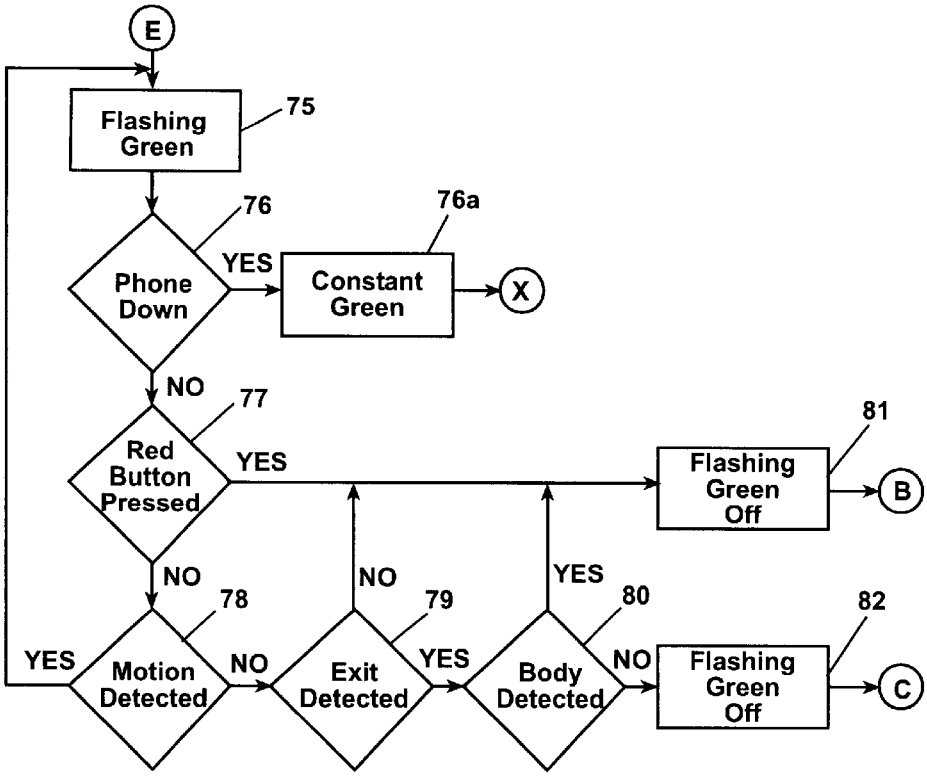

When the "Do not disturb" routine E in FIG. 4G is initiated, the green lights are switched from the constant to a flashing mode at step 75, to indicate that the occupant wishes not be disturbed. If the receiver is placed back in its cradle at step 76, the green lights are switched from the flashing mode to the constant mode at step 76*a* and the program returns to step 21 of routine A1 in FIG. 4B. If the receiver is not placed back in its cradle at step 76, and the red button (or its computer equivalent) is not pressed at step 77, and motion is detected at step 78 the program returns to step 75. If the red button is pressed at step 77, the flashing green lights are turned off at step 81 and the program branches to the emergency alarm routine B shown in FIG. 4C. If no motion is detected in the space at step 78, and no exit of the occupant through the entryway is detected at step 79, the flashing green lights are turned off at step 81 and the emergency alarm routine is initiated. If the apparent exit of the occupant through the entryway is detected at step 79, but the presence of an inert body is detected in the space at step 80, the flashing green lights are turned off at step 81 and the emergency alarm routine is initiated. If the presence of an inert body is not detected at step 80, the flashing green lights are turned off at step 82 and the program branches to the short duration absence routine C in FIG. 4D.

If no motion is detected in the space at step 23 of routine A1 in FIG. 4B, and no exit of the occupant from the space is detected at step 25, the constant green lights are turned off at step 18 and the program branches to the emergency alarm routine B shown in FIG. 4C. If the apparent exit of the occupant is detected at step 25 but the presence of an inert body is detected in the space at step 26, the constant green lights are turned off at step 18 and the emergency alarm routine is initiated. If the presence of an inert body is not detected at step 26, the constant green lights are turned off at step 27 and the program branches to the long duration absence routine D shown in FIGS. 4E and 4F. If the red button (or its computer equivalent) is pressed at step 24, the constant green lights are turned off at step 18 and the emergency alarm routine is initiated.

When the long duration absence routine D in FIGS. 4D and 4E is initiated, the amber lights are displayed in the constant mode at step 39. If no entry is detected at step 40 and working hours plus a predetermined time period have not ended at step 43, the exit checking continues. When working hours plus a predetermined time period have ended at step 43, the constant amber lights are turned off at step 44 and the program returns to step 1 of routine A in FIG. 4A. If entry is detected at step 40, and motion is not detected at step 41 and the presence of an inert body in the space is not detected at step 42, the program returns to step 43. If the presence of an inert body is detected at step 42, the constant amber lights are turned off at step 45 and the program branches to the emergency alarm routine B shown in FIG. 4C. If motion is detected at step 41, and the green button (or its computer equivalent) is not pressed at step 46, the constant amber lights are turned off at step 47, and the program returns to step 9 of routine A1 in FIG. 4B. If the green button is pressed at step 46, the green lights are displayed in the constant mode at step 48 in combination with the constant amber lights, to indicate that the space is being used by one or more visitors during the regular occupant's absence.

When the amber and green lights are being displayed together in the constant mode at step 48, and the red button (or its computer equivalent) is not pressed at step 49, and motion is detected at step 50, and the green button (or its computer equivalent) is not pressed at step 51, the program returns to step 48. If the red button is pressed at step 49, the constant amber and green lights are turned off at step 54, and the program branches to the emergency alarm routine B shown in FIG. 4C. If the red button is not pressed at step 49 and no motion is detected at step 50, but the exit of the occupant through the entryway is not detected at step 52, the constant amber and green lights are turned off at step 54, and the emergency alarm routine is initiated. If the apparent exit of the occupant through the entryway is detected at step 52, but the presence of an inert body in the space is detected at step 53, the constant amber and green lights are turned off at step 54, and the emergency alarm routine is initiated. If the presence of an inert body is not detected at step 53, the constant green lights are turned off at step 55, and the program returns to step 39.

If the green button (or its computer equivalent) is pressed at step 51, the green lights are switched from the constant mode to a flashing mode at step 60 in FIG. 4F and displayed in combination with the constant amber lights, to indicate that the visitor to the workspace wishes not to be disturbed. A predetermined amount of time is then added to an internal timer at step 61 and the program begins a countdown period at step 62. If the red button (or its computer equivalent) is not pressed at step 63 and motion is detected at step 64 and the green button (or its computer equivalent) is not pressed at step 65, the program returns to step 62. If the red button is pressed at step 63, the constant amber and flashing green lights are turned off at step 73 and the program branches to the emergency alarm routine B shown in FIG. 4C. If the red button is not pressed at step 63, and no motion is detected at step 64, but the exit of the occupant through the entryway is not detected at step 71, the constant amber and flashing green lights are turned off at step 73 and the emergency alarm routine is initiated. If the apparent exit of the occupant is detected at step 71 but the presence of an inert body is detected in the space at step 72, the constant amber and flashing green lights are turned off at step 73 and the emergency alarm routine is initiated. If the presence of an inert body is not detected at step 72, the flashing green lights are turned off at step 74 and the program returns to step 39 of routine D in FIG. 4E.

During the visitor-initiated "Do not disturb" period, the green button (or its computer equivalent) may be pressed at step 65 and held down at step 68 to add one or more increments of time to the timer at step 69. The beeper is sounded for a fraction of a second at step 70 to register each additional increment of time and the program returns to step 65. If the green button is pressed at step 65 but not held down at step 68, the program returns to step 48 of routine D in FIG. 4E. When the amount of time added to the timer either by default and/or by choice has elapsed at step 62, the beeper is sounded for a fraction of a second at step 66 to indicate that the "Do not disturb" period is almost over. The green button may then be pressed within a few seconds at step 67 and held down at step 68 to extend the "Do not disturb" period via steps 69–70 as previously described. If the green button is not pressed at step 67, the program returns to step 48 of routine D in FIG. 4E.

When the green lights are being displayed in the constant mode at step 9 of routine A1 in FIG. 4B, and no emergency routine is initiated at steps 10, 11, 16, or 17, no short duration absence routine at step 20, and no long duration absence routine at step 12, the amber and green buttons (or their computer equivalents) may be pressed simultaneously at step 13 to set the system's internal clock to 24:00:00 at step 28 and return to step 9. If the amber and green buttons are not pressed simultaneously at step 13, and the receiver of the telephone in the space is lifted from its cradle at step 14, the program branches to the "Do not disturb" routine F shown in FIG. 4H.

Figure 4H:
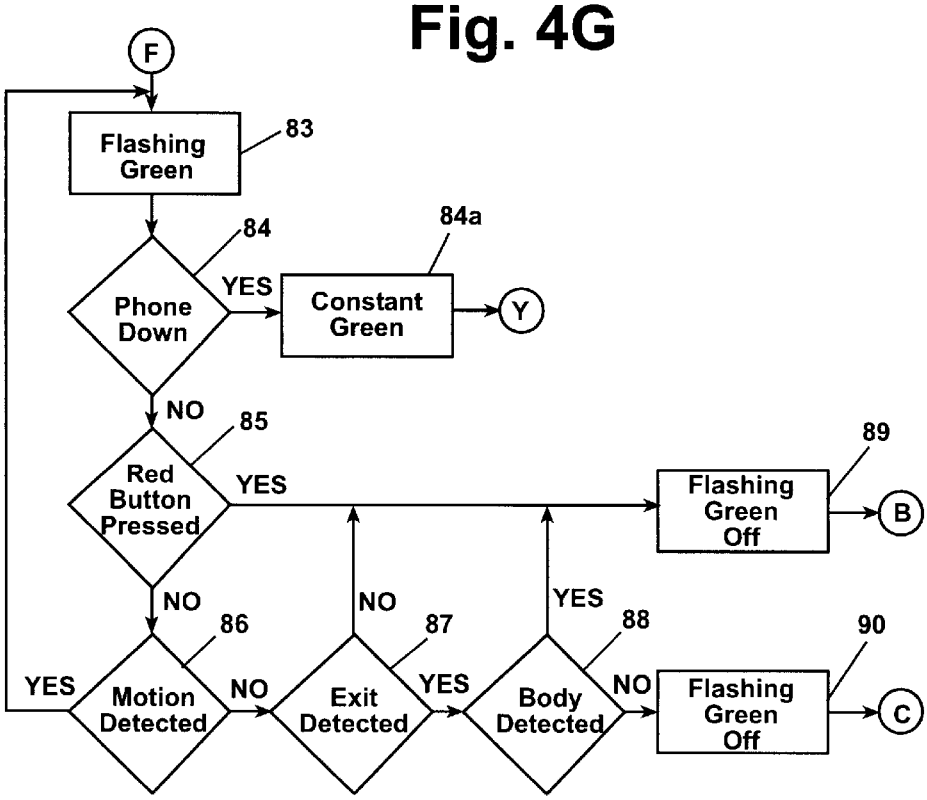

When the "Do not disturb" routine F in FIG. 4H is initiated, the green lights are switched from a constant to a flashing mode at step 83. If the receiver is placed back in its cradle at step 84, the green lights are switched from a flashing mode to the constant mode at step 84*a* and the program returns to step 13 of routine A1 in FIG. 4B. If the receiver is not placed back in its cradle at step 84, and the red button (or its computer equivalent) is not pressed at step 85 and motion is detected at step 86, the program returns to step 83. If the red button is pressed at step 85, the flashing green lights are turned off at step 89 and the program branches to the emergency alarm routine B shown in FIG. 4C. If the red button is not pressed at step 85 and no motion is detected at step 86, but the exit of the occupant through the entryway is not detected at step 87, the flashing green lights are turned off at step 89 and the emergency alarm routine is initiated. If the apparent exit of the occupant through the entryway is detected at step 87, but the presence of an inert body in the space is detected at step 88, the flashing green lights are turned off at step 89 and the emergency alarm routine is initiated. If the presence of an inert body is not detected at step 88, the green lights are turned off at step 90 and the program branches to the short duration absence routine C shown in FIG. 4D.

Figure 4I:
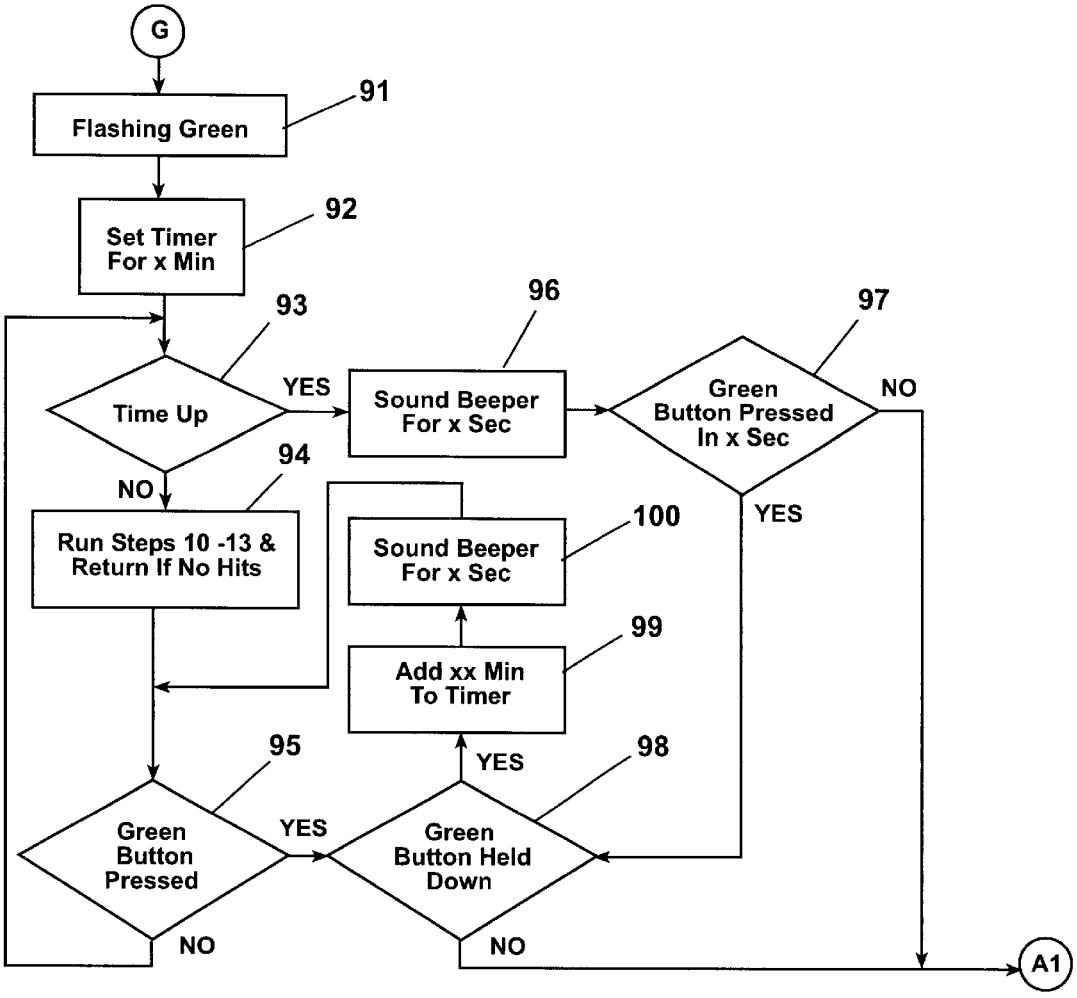

When the green lights are displayed in the constant mode at step 9 of routine A1 in FIG. 4B, and no emergency routine is initiated at step 10, 11, 16, or 17, no short duration absence routine at step 20, no long duration absence routine at step 12, and no clock reset routine at step 13, and the receiver of the telephone in the space is not lifted from its cradle at step 14, the green button (or its computer equivalent) may be pressed at step 15, to initiate the "Do not disturb" routine G shown in FIG. 4I. If the green button is not pressed at step 15, the program returns to step 9.

When the "Do not disturb" routine G in FIG. 4I is initiated, the green lights are switched from the constant to a flashing mode at step 91 and a predetermined amount of time is automatically added to the timer at step 92. The program begins a countdown period at step 93, during which the program checks for the manual or automatic initiation of the emergency alarm, long duration absence, and clock resetting routines at step 94 and branches accordingly. If no branches occur at step 94, and the green button (or its computer equivalent) is not pressed at step 95, the program returns to step 93. If the green button (or its computer equivalent) is pressed at step 95 and held down at step 98, one or more increments of time are added to the timer at step 99. The beeper sounds for a fraction of a second at step 100 to register each additional increment of time and the program returns to step 95. If the green button (or its computer equivalent) is pressed at step 95 but not held down at step 98, the program returns to step 9 of routine A1 in FIG. 4B. When the amount of time added to the timer by default and/or by choice has elapsed at step 93, the beeper sounds for a fraction of a second at step 96 to indicate that the "Do not disturb" period is almost over. The green button (or its computer equivalent) may then be pressed within a few seconds at step 97 and held down at step 98 to extend the "Do not disturb" period via steps 99–100 as previously described. If the green button (or its computer equivalent) is not pressed at step 97, the program returns to step 9 of routine A1 in FIG. 4B.

Figure 4J:
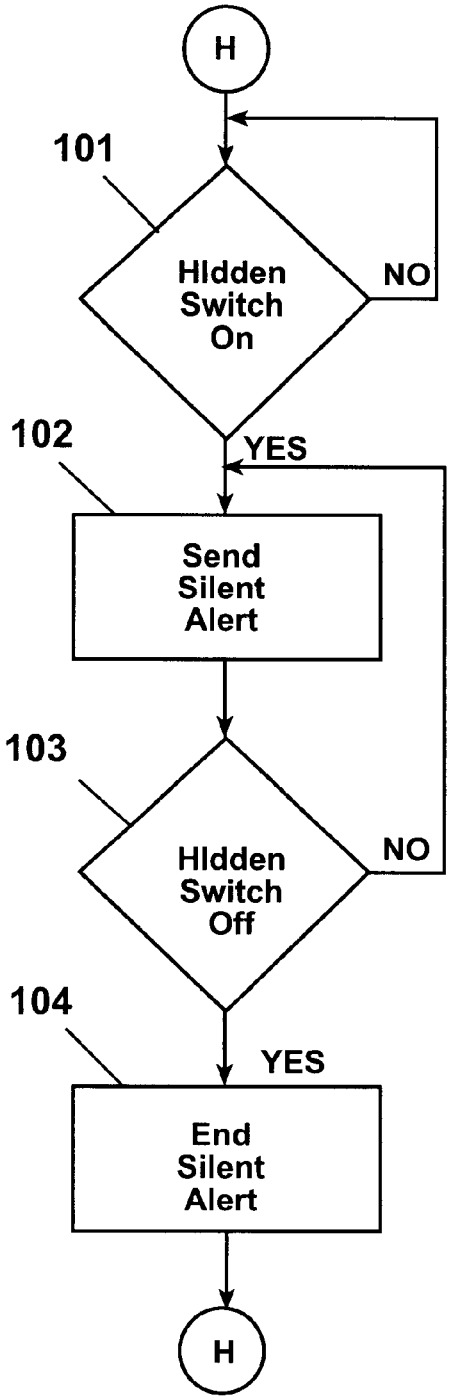
FIG. 4J is a partial flowchart of software for the silent alert.

If the controller or the computer is linked to a communications network, and the occupant of the space is physically threatened by a third party, a concealed switch may be used to send a silent alert to one or more remote locations, independently of the control program, without giving any audio-visual indication at the sender's location. The logic for the silent alert is shown in routine H in FIG. 4J. The concealed switch is turned on at step 101 to send a silent, remote alert at step 102. The alert continues until the concealed switch is turned off at step 103. The silent alert is then ended at step 104 and the program returns to step 101.

While the invention has been specifically described in connection with certain specific embodiments thereof, it is to be understood that this is by way of illustration and not of limitation, and the scope of the appended claims should be construed as broadly as the prior art will permit. the program returns to step 9 of routine A1 in FIG. 4B. When the amount of time added to the timer by default and/or by choice has elapsed at step 93, the beeper sounds for a fraction of a second at step 96 to indicate that the "Do not disturb" period is almost over. The green button (or its computer equivalent) may then be pressed within a few seconds at step 97 and held down at step 98 to extend the "Do not disturb" period via steps 99–100 as previously described. If the green button (or its computer equivalent) is not pressed at step 97, the program returns to step 9 of routine A1 in FIG. 4B.

If the controller or the computer is linked to a communications network, and the occupant of the space is physically threatened by a third party, a concealed switch may be used to send a silent alert to one or more remote locations, independently of the control program, without giving any audio-visual indication at the sender's location. The logic for the silent alert is shown in routine H in FIG. 4J. The concealed switch is turned on at step 101 to send a silent, remote alert at step 102. The alert continues until the concealed switch is turned off at step 103. The silent alert is then ended at step 104 and the program returns to step 101.

While the invention has been specifically described in connection with certain specific embodiments thereof, it is to be understood that this is by way of illustration and not of limitation, and the scope of the appended claims should be construed as broadly as the prior art will permit.

What is claimed is:

1. An occupancy status indicator comprising:

a motion detector adapted to send a signal when it detects motion in a space and when it detects the presence of a person in the space;

an indicator for displaying information about the occupancy of the space; and a controller connected to the motion detector and the indicator wherein the controller will activate the indicator to display a first condition when the motion detector signals motion in the space and the presence of a person in the space, said motion and presence being a first status;

activate the indicator to display a second condition when no motion is detected in the space and the motion detector signals the presence of a person in the space, said presence and lack of motion being a second status; and activate the indicator to display a third condition when no motion is detected in the space and no person is detected in the space, said lack of motion and lack of presence being a third status.

2. An occupancy status indicator according to claim 1 wherein the motion detector is a passive infrared sensor.

3. An occupancy status indicator according to claim 1 wherein the controller is a computer.

4. An occupancy status indicator according to claim 1 wherein the indicator is a visual display.

5. An occupancy status indicator according to claim 4 wherein the visual display comprises three lights.

6. An occupancy status indicator according to claim 5 wherein the lights are red, amber, and green, and wherein the green light is displayed for the first condition, the red light is displayed for the second condition, and the amber light is displayed for the third condition.

7. An occupancy status indicator according to claim 4 wherein the visual display appears on a computer screen.

8. An occupancy status indicator according to claim 1 wherein the controller is further connected to a communications network.

9. An occupancy status indicator according to claim 1 wherein the indicator is remote from the space.

10. An occupancy status indicator according to claim 1 wherein the space is defined by a cubicle and the indicator is mounted on the cubicle.

11. An occupancy status indicator according to claim 1 wherein the space is partially enclosed and accessible by an entryway, and the motion detector is positioned to detect the direction of motion through the entryway.

12. An occupancy status indicator according to claim 1 wherein one of the controller and the motion detector determine when no motion exists by sensing a predetermined period of elapsed time from the last motion signal.

13. An occupancy status indicator according to claim 4 wherein the indicator further comprises an audio display.

14. An occupancy status indicator according to claim 13 wherein the audio display is a beeper that is activated only for the second status.

15. An occupancy status indicator according to claim 1 wherein the controller has a component, manually operable, to activate the indicator.

16. An occupancy status indicator according to claim 1 further comprising a concealed switch to send an alarm to one or more remote locations.

17. An occupancy status indicator according to claim 1 wherein the first condition comprises two modes, one indicating that the space is occupied and the other indicating that the space is occupied with a restriction that the occupant not be disturbed.

18. An occupancy status indicator according to claim 1 wherein the third condition comprises two modes, one indicating a short duration absence and the other indicating a long duration absence.

19. An occupancy status indicator according to claim 1 further comprising a second indicator in the space wherein the second indicator replicates the display of the indicator.

* * * * *